US005300746A

United States Patent [19]

Walters et al.

[11] Patent Number: 5,300,746

[45] Date of Patent: Apr. 5, 1994

[54] METALLIZED MICROWAVE DIFFUSER FILMS

[75] Inventors: Glenn J. Walters, Duxbury, Mass.; John A. McCormick, Ontario, Canada

[73] Assignee: Advanced Deposition Technologies, Inc., Taunton, Mass.

[21] Appl. No.: 756,165

[22] Filed: Sep. 6, 1991

Related U.S. Application Data

[63] Continuation-in-part of Ser. No. 610,752, Nov. 8, 1990, abandoned.

[51] Int. Cl.[5] ..... H05B 6/80

[52] U.S. Cl. ..... 219/745

[58] Field of Search ..... 219/10.55 E, 10.55 F, 219/10.55 R, 10.43; 99/DIG. 14; 428/323, 332; 156/651, 272, 233, 234; 426/107, 234, 243, 211, 213

[56] References Cited

U.S. PATENT DOCUMENTS

| | | | |
|---|---|---|---|
| 3,547,661 | 12/1970 | Stevenson | 219/10.55 E |
| 4,230,924 | 10/1980 | Brastad et al. | 219/10.55 |
| 4,258,086 | 3/1981 | Beall | 219/10.43 |
| 4,656,325 | 4/1987 | Keefer | 219/10.55 E |
| 4,676,857 | 6/1987 | Scharr et al. | 156/233 |
| 4,883,936 | 11/1989 | Maynard et al. | 219/10.55 F |
| 4,927,991 | 5/1990 | Wendt et al. | 219/10.55 |
| 4,933,193 | 7/1990 | Fisher | 426/107 |
| 4,940,867 | 7/1990 | Peleg | 219/10.55 |
| 4,962,000 | 10/1990 | Emslander et al. | 428/461 |
| 4,962,293 | 10/1990 | Lackey | 219/10.55 |
| 4,963,424 | 10/1990 | Beckett | 428/209 |
| 4,972,059 | 11/1990 | Wendt et al. | 219/10.55 |
| 4,985,300 | 1/1991 | Huang | 428/332 |
| 5,006,405 | 4/1991 | Watkins et al. | 428/323 |
| 5,038,009 | 8/1991 | Babbitt | 219/10.55 E |
| 5,059,279 | 10/1991 | Wilson | 156/651 |

*Primary Examiner*—Bruce A. Reynolds
*Assistant Examiner*—Tu Hoang
*Attorney, Agent, or Firm*—Wolf, Greenfield & Sacks

[57] ABSTRACT

Microwave diffuser films are describe that provide a modified microwave energy field on one side of the diffuser film and on the other side. The films include an insulative substrate having a first side upon which is deposited a metallic coating capable of selectively reflecting a portion of incoming microwave energy. A coating is formed in a plurality of discrete areas having a predetermined reflectivity. The shape and spacing of the areas may be varied so that energy emission from noncoated surfaces of the substrate is spatially distributed in one or more ways; i.e. the energy emission more uniform than the energy impinging on the coated surface, the energy emission is focused on one or more particular location and/or the energy emission is shielded. A food packaging system for microwave cooking, which includes the microwave diffuser film of this invention, is also described.

27 Claims, 8 Drawing Sheets

METALLIZED MICROWAVE DIFFUSER FILMS

The present application is a continuation-in-part of co-pending application Ser. No. 07/610,752, entitled "Microwave Food Packaging", filed Nov. 8, 1990, now abandoned, the entire contents of which are expressly incorporated herein by reference.

FIELD OF THE INVENTION

The present invention relates to microwave diffuser films for use in packaging of microwaveable food products.

BACKGROUND OF THE INVENTION

Microwave cooking relies upon dielectric heating of foods responsive to microwave radiation. Because of the nature of microwave cooking, the heating characteristics in a microwave oven for some food products are dramatically different from those experienced in a conventional oven. Moreover, the use of microwave ovens can result in undesirable temperature differentials for a variety of food products. For example, some food products when cooked in a microwave oven, will heat to a greater extent on the interior of the product rather than on the product surface because of dielectric microwave heating which favors heating of the product interior.

The above problems are well-known in the art of microwave cooking and numerous attempts have been made to solve them, none of them entirely satisfactory. In conventional microwave packaging and cooking containers, this problem of uneven heating is ameliorated by instructing the user to leave the material unattended for a few minutes after the normal microwave cooking time in order for thermal conduction within the food to redistribute the heat evenly. Alternatively, the material may be stirred, if it is of a type which can be stirred.

The problem of uneven heating in microwave ovens can be exacerbated by typical packaging systems which employ microwave susceptors that are designed to heat the food. Microwave susceptors typically contain one or more thin metallic layers designed to absorb substantial amounts of microwave energy and to convert this energy into thermal energy.

The resistivity of a thin, metallic structure is a function of the thickness of the structure. Thin metal layers of typical susceptors have resistivities greater than about 20 ohms per square. At these values, the metallized layer reflects a smaller percent of microwave energy than a layer having lower resistivity. Thus, layers with high surface resistivities such as the metal layers used in typical susceptors, will absorb a significant portion of the impinging electromagnetic energy when illuminated with microwaves. A higher percentage of impinging microwaves will therefore penetrate the susceptor layers than will penetrate layers formed of very low surface resistance values.

These susceptors often suffer physical deterioration when exposed to microwave radiation, the result of very rapid microwave penetration and subsequent heating which occurs during the early stage of heating cycle. This heating causes the material to undergo dimensional changes which can damage the structure and the resulting reflective and transmissive properties of the susceptor material. Susceptors undergoing physical change from this intense internal heating often show an increase in microwave transmission into a food product. This results in either burning of the food or uneven heating.

Moreover, structures such as those used in many potato chip bags and drip coffee pouches incorporate a continuous, metallic layer having low surface resistance (i.e. less than about 2 ohms per square) layer. These structures disintegrate almost as soon as they are irradiated with microwave radiation. These structures presently unsuitable for microwave use.

Current attempts to control the amount and spatial distribution of microwaves during microwave cooking include using, on at least one surface of a container, one or more electrically conductive diffuser plates and/or microwave-transparent diffuser apertures that are not themselves designed to heat the food product.

At least one such attempt has been made in the prior art to control distribution of heating, described in detail in U.S. Pat. No. 4,927,991 to Wendt et al., the disclosure of which is incorporated herein by reference. Although addressing a number of significant issues relating to microwave diffusers, the Wendt patent describes an aluminum foil grid diffuser that is a very costly and complex addition to a microwaveable food package. Moreover, it is well known that as the resistivity of a metallic coating such as aluminum decreases, a surface charge accumulates which can result in severe arcing on the metal surface. Arcing is an inherent possibility at the site of any lowered resistivity such as nicks or sharp edges in reflecting grid diffusers.

Thus, a significant need exists for a simple, inexpensive microwave diffuser having low resistivity that will not arc, will not itself heat up enough to directly heat food but will distribute a microwave field within the food packaging in a well-defined way.

SUMMARY OF THE INVENTION

The present invention relates to a microwave diffuser film for microwave cooking that is not particularly susceptible to microwave-induced heating and/or arcing. The invention includes a microwave-transparent substrate upon which is deposited microwave-interactive elements that can reflect a predetermined amount of microwave radiation. The elements are designed to have known microwave reflectance and transmittance characteristics, thereby reducing the amount of microwave radiation that is transmitted through the substrate and into the environment of use.

By judicious selection of the number, type, and arrangement of microwave-interactive elements, the diffuser film can screen out excess microwave energy which creates hot zones within a microwave oven due to magnetron design, cavity design, and food configuration. Positioning of the elements will also minimize arcing between large areas of metallized coatings. Furthermore, the diffuser film acts as a selective filter which can spatially distribute the microwave energy field. The diffuser can focus microwave energy, it can shield material from microwave energy or it can create a more uniform microwave energy field on the side of the diffuser opposite to the side receiving microwave energy.

In one embodiment of the invention, the diffuser film includes a microwave-transparent substrate comprising an electrical insulator, preferably a polymeric film. Microwave-reflective elements are deposited as one or more metallized coatings onto a first surface of the substrate that receives microwave energy. Microwave energy is transferred through the substrate and across one or more other surfaces into the environment of use. In one embodiment, a uniform reflective coating can be deposited and subsequently de-metallized in selected regions to provide areas lacking reflectivity within a larger reflective coating.

In its preferred embodiment, the microwave-reflective coating of the present invention comprises a thin, noncontinuous patterned metallic layer of elements separated by nonmetallic gaps or slots. This pattern of reflective metallic elements and narrow, nonreflective gaps reflects a portion of the impinging microwave energy and reorganizes that which passes through the structure. Only a small amount of the impinging microwave energy is absorbed by the metallic layer so that the structure does not act as a susceptor.

In a particularly preferred embodiment, opposed sides of a microwave-transparent substrate are coated with a patterned metallic layer in a mesh-like arrangement. The amount of microwave energy transferred through the structure can be adjusted by changing the position of the mesh-like structures relative to each other so that the nonmetallic slots of the mesh pattern are not superimposed one above the other (i.e. are in phased array).

In another preferred embodiment, one side of a microwave-transparent substrate is coated with a patterned metallic layer in a pinwheel-like arrangement. In this configuration, elongated metallized elements are deposited on a surface of the substrate so that the elements radiate outwardly from a central, nonmetallized region, similar to spokes arranged around a central wheel hub. This particular pattern redistributes and focuses microwave energy at the central, nonmetallized area.

In another embodiment of the invention, the diffuser film can be one component of a food package for heating foods. The package can include a susceptor for directly heating the food in response to microwave energy, a separate diffuser film of the invention, a packaging means containing at least the susceptor and diffuser and, optionally, a food item to be cooked by microwave energy. The diffuser film includes a substrate having a first side that receives microwave energy. This side has deposited on it reflective elements in a predetermined pattern. Microwave energy is transferred through the substrate and exits into the environment of use through at least one other side of the substrate.

It is therefore an object of the present invention to provide a structure which is capable of selectively controlling the amount of microwave energy passing through it so that focused heating of food by microwaves can be achieved.

It is a further object of the invention to provide a structure which significantly reduces the amount of microwave oven-generated electromagnetic energy passing through the material or an area of the material.

It is yet a further object of the present invention to provide a structure which significantly reorganizes microwave oven-generated electromagnetic energy which passes through the structure so that the microwave energy field is more uniform on one side of the structure than on the other.

It is a further object of the present invention to provide a packaging material containing patterned conductive metal layers with moderate surface resistance that can survive the environment of the microwave oven at a thickness which makes these materials economical to incorporate into microwave food packages.

DETAILED DESCRIPTION OF THE INVENTION

The microwave diffuser film of the invention is designed to spatially distribute or modify a microwave field within an environment of use without undergoing substantial heating due to microwave absorption. The microwave diffuser film includes a flexible substrate upon which is deposited microwave-interactive elements in a predetermined pattern. The pattern is selected in order to eliminate arcing and to reflect a portion of the microwave field in such a manner as to spatially distribute or modify the microwave field. The terms "spatially distribute" or "modify" are used interchangeably and refer to the fact that the diffuser film of the invention is capable of either shielding specific areas of the food, creating a more uniform microwave field on the side of the diffuser away from the microwave field source than on the side of the diffuser towards the microwave field source, and/or focusing microwave energy to one or more particular locations.

Figure 1:
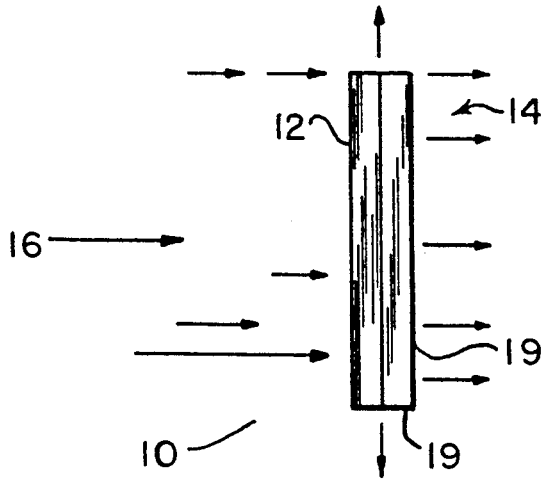
FIG. 1 is a schematic illustration of the microwave field changes caused by the diffuser film of the invention.

The concept of spatially distributing a microwave field is illustrated schematically in FIG. 1 which shows a microwave-interactive diffuser film 10, including a substrate 14 and a reflective coating 12. A microwave source (not shown) produces microwave energy 16 that impinges upon coating 12. Typically, the microwave energy field 16 is produced by a magnetron of a microwave oven. To the extent that there are "hot spots" in the microwave energy field due to magnetron design, design of the cavity in which the magnetron resides, and configuration of the material to be heated by the microwave source, the microwave energy 16 received per unit area of coating 12 is nonuniform. This nonuniformity of the impinging microwave energy is depicted as arrows of different lengths.

Substrate 14 is not electrically conductive (i.e. it is an insulator) and does not absorb substantial amounts of microwave energy. Therefore, the substrate 14 is substantially transparent to microwave energy and will not heat when irradiated with microwaves. The diffuser film 10 illustrated in FIG. 1 is designed to selectively interact with the incoming microwave energy in such a manner that the microwave energy field 16, transferred through the substrate 14 and across interface 19 of the substrate with the outside environment, is more uniform than the microwave energy 16 field impinging on the coating 12. This is illustrated as arrows of equal length exiting the substrate interfaces.

Figure 2:
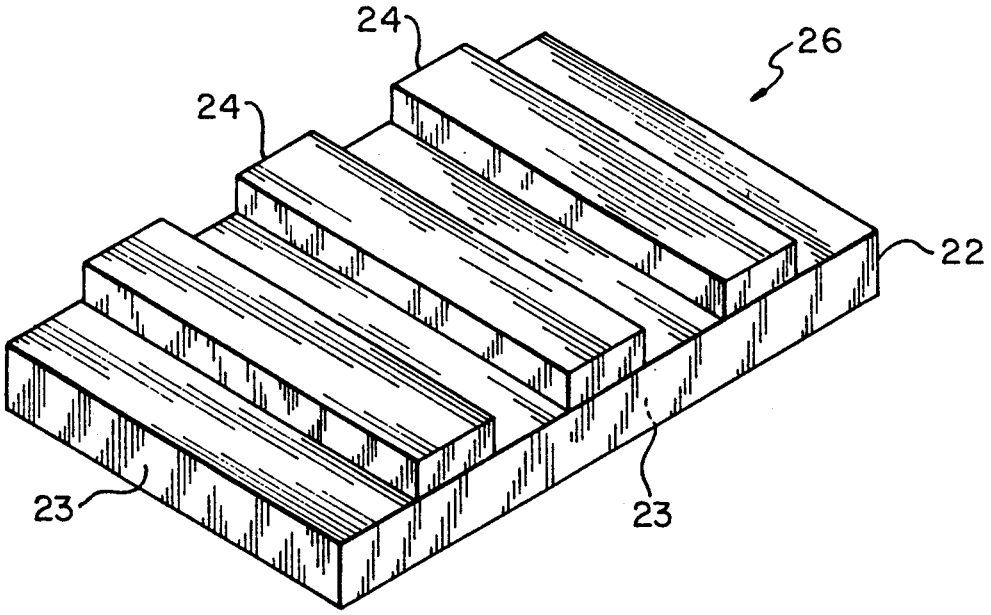
FIG. 2 is a schematic, perspective representation of one embodiment of a microwave diffuser having a discontinuous reflecting film.

As depicted in FIG. 2, one embodiment of the present invention comprises a planar substrate 22 having a first surface 21 upon which is deposited a microwave interactive coating 24. The term "microwave-interactive" refers to a coating that is primarily for reflecting a portion of the microwave radiation to which the substrate is exposed. By varying the reflectivity of coating 24, the diffuser film 26 can be made selectively permeable to microwave energy. The term "selectively permeable" refers to a diffuser film 26 that can control the amount of microwave energy transferred through the substrate 22 and across second surface 23 between the substrate and the environment of use.

Figure 3:
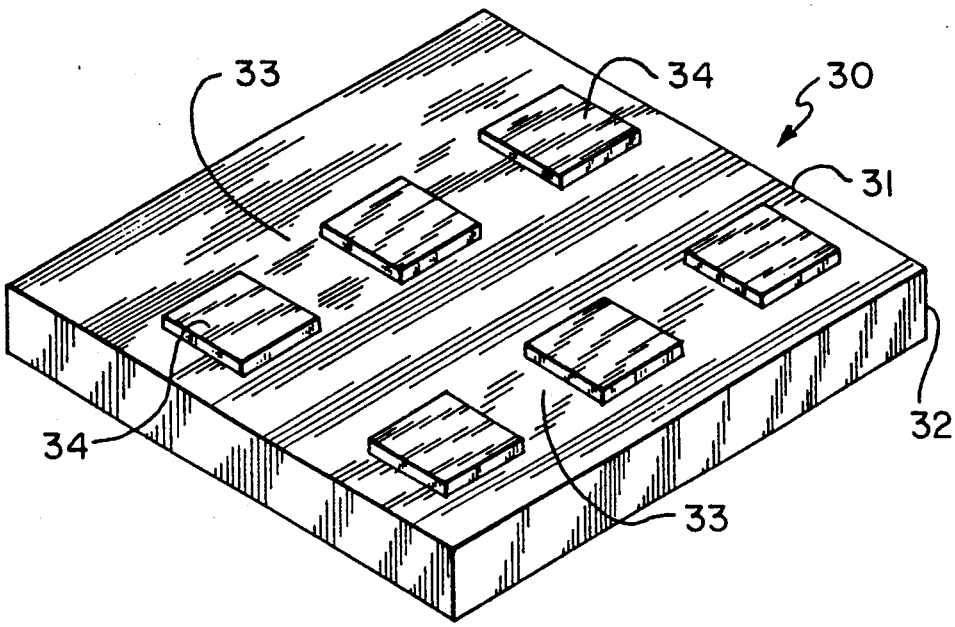
FIG. 3 is a schematic, perspective representation of a second embodiment of a microwave diffuser having a discontinuous reflecting film.

As illustrated in FIG. 2, and discussed in more detail below, the diffuser film preferably can include a microwave-interactive coating disposed as discontinuous elements deposited upon a surface of the polymeric substrate that is closest to the microwave source. The elements can be in the form of a series of rectangles, squares, circles, parallel stripes, triangles, or other patterns. The discrete nature of the elements allow portions of the microwave field to contact directly the polymeric substrate between the discontinuous elements without being reflected by the elements. FIG. 3 depicts one preferred configuration of a diffuser film 30, in which a plurality of discontinuous quadrilateral (i.e. square or rectangular) microwave-interactive elements 34 are deposited onto a first surface 31 of a substrate 32. The elements are separated from each other by a continuous coating-free gap or slot 33. In this embodiment, about 85% to about 90% of the surface area of the substrate is covered. It is understood that elements 34 can be in a variety of other geometric shapes such as circular, triangular, and the like. The preferred area of the quadrilateral elements ranges from about 1 $mm^2$ to about 625 $mm^2$ and the coating-free gap preferably ranges in width from about 0.2 mm to about 2.0 mm.

The microwave-interactive elements can be applied by any deposition process, which will not damage the substrate or the deposited coating. In one embodiment, a vapor deposition process is preferred. This vapor deposition process can be any process in which materials are deposited upon substrates from the vapor phases. Deposition methods such as chemical and physical vapor deposition (CVD, PVD) which includes sputtering, ion plating, electroplating, electron beam and resistive or inductive heating are intended to be included herein. While methods for providing the microwave-interactive material in the vapor phase are preferred, the invention is not intended to be limited by the method of forming the diffuser elements. Rather, any method for applying microwave-interactive materials can be used, provided the method does not damage the substrates upon which the materials are being deposited.

Preferred microwave-interactive elements used in the invention have a resistivity in the range of about 0.05 to about 2.0 ohms per square and can comprise a single metal, a metal alloy, a metal oxide, a mixture of metal oxide, a dispersion of reflective metallic or reflective nonmetallic materials in a binder, or any combination of the foregoing. Suitable exemplary metals include aluminum, iron, tin, tungsten, nickel, stainless steel, titanium, magnesium, copper and chromium. Preferably, the microwave-interactive coating comprises aluminum, alloy or other metal coatings. A thicker film for this coating is preferred. In a thicker layer, reflection is favored over transmission and surface oxidation as a percentage of overall film thickness becomes smaller as film thickness is increased. By minimizing the relative percentage of film layer oxidation, performance of the microwave-interactive coating is made more stable.

The substrate upon which the microwave-interactive coating is deposited preferably comprises an electrical insulator, e.g., a polymeric film which can be oriented or unoriented. Materials considered to be useful as the substrate include, for example, polyolefins (e.g. polyethylene or polypropylene), polyesters, polyamides, polyimides, polysulfones, polyethers, ketones, cellophanes, and various blends of such materials. Insulative substrate materials can also include paper and paper laminates, metal oxides, silicates and cellulosics. In one embodiment, the substrate comprises a polyester film of the order of approximately 0.2 mil to approximately 2 mil thick. The thickness of approximately 0.5 mil is preferred.

The embodiment of the invention depicted in FIGS. 2 and 3 can be alternatively fabricated by a process in which a relatively thick microwave-interactive coating is deposited upon a surface of the substrate and then selectively removed using any of a variety of removal techniques known in the art to form the desired pattern. The removal is preferably complete so that coating material is removed down to the substrate surface.

Figure 4:
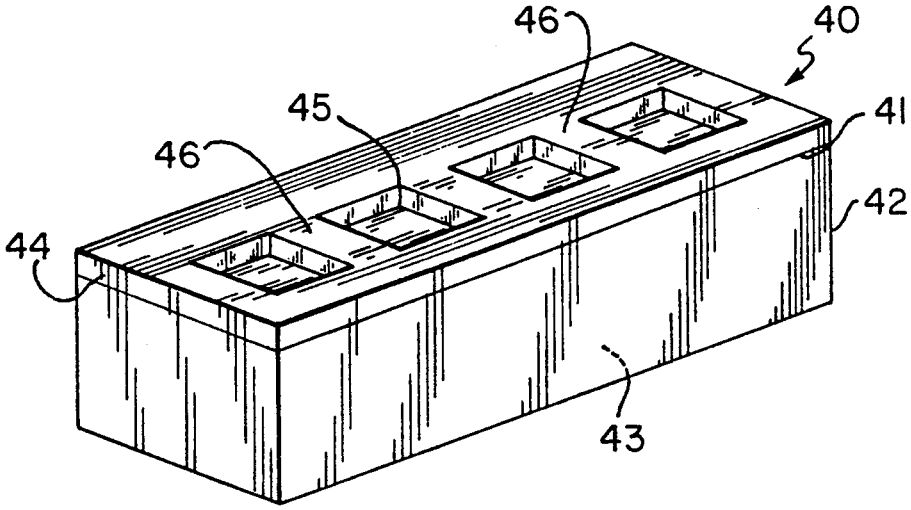
FIG. 4 is a schematic, perspective representation of an embodiment in which the patterns are provided by de-metallizing the reflective coating.

For example, as illustrated in FIG. 4, the microwave-interactive coating can comprise a series of geometric patterns originally deposited as a uniform layer, with pattern formation occurring during subsequent demetallization steps. FIG. 4 depicts a diffuser film 40 having a substrate 42 with opposed first and second surfaces 41, 43. Upon first surface 41 is deposited a microwave-interactive coating 44 having elements comprising a plurality of quadrilateral cutouts 45 separated by metallic gaps 46.

Figure 5:
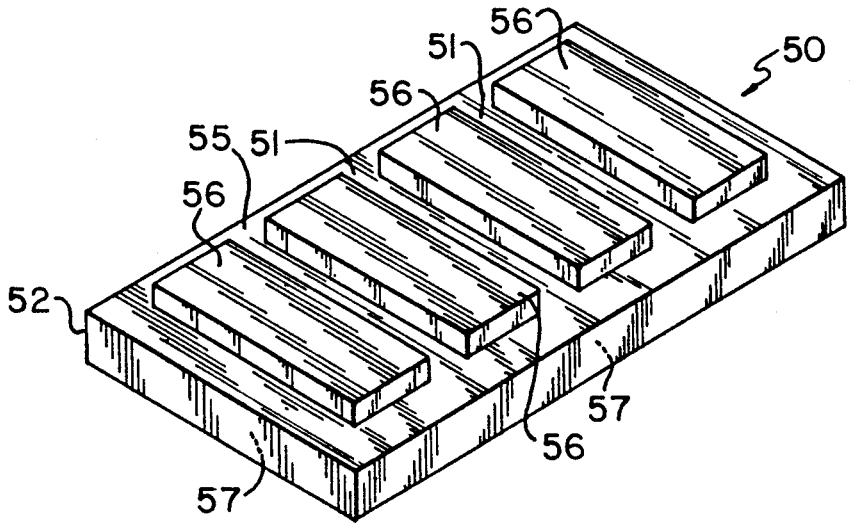
FIG. 5 is a schematic, perspective representation of an embodiment of a microwave diffuser film having a relatively large reflective surface.

FIG. 5 illustrates that the diffuser film 50 can also include a polymeric substrate 52 having a microwave-interactive coating comprising a plurality of discrete, rectangular elements 56 deposited on a first surface 55 of the substrate closest to the microwave energy source. In this example, relatively large elements 56 separated by nonreflective gaps 51 which cover a larger surface portion of the substrate serve to reflect a portion of microwave energy and therefore allow a lower amount of energy to be transmitted into the substrate 52 and transferred through the substrate into the environment of use by way of second surfaces 57.

Other such diffuser films can easily be fabricated which contain regions covering a relatively small area of the substrate onto which microwave energy is received. These small regions serve to reflect a smaller portion of microwave energy and therefore allow a relatively large amount of energy to be transferred through the substrate and into the environment of use. The modification of the microwave field transferred through the film will be determined by the pattern, number and type of reflective elements deposited.

Figure 6:
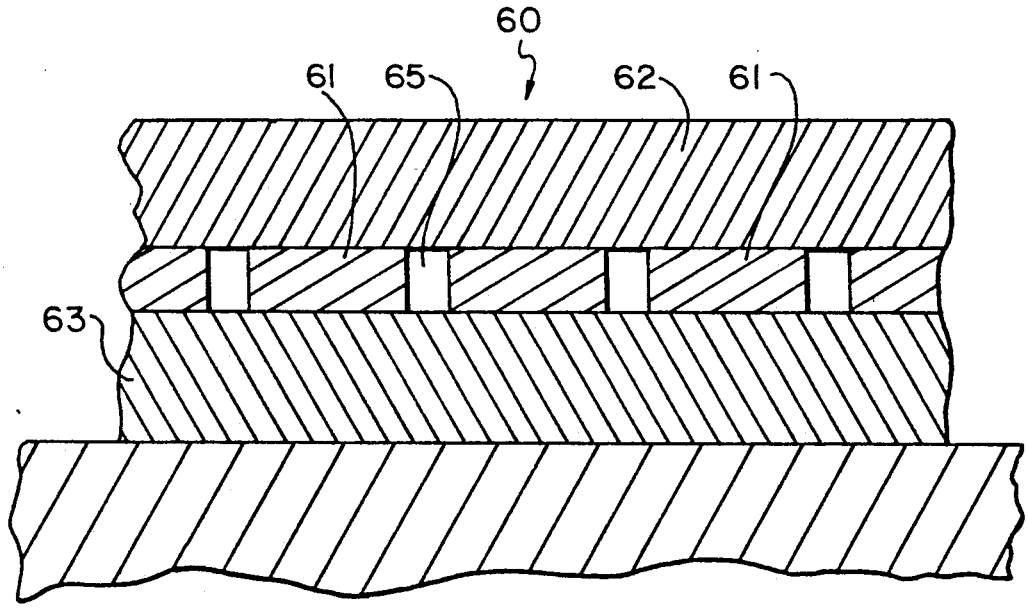
FIG. 6 is a cross-sectional view of one embodiment of the invention.

A resistivity specifically between about 0.05 ohms per square to about 1 ohm per square are values typical of conventional structures such as potato chip bags and drip coffee pouches, not heretofore microwaveable. A selectively permeable diffuser film of the invention employing microwave interactive elements having these resistance values can be used for microwave packaging materials. The preferred structure comprises a "sandwich" configuration in which a pattern of metallic elements separated by nonmetallic areas is deposited between two layers of insulative substrate. As described previously, this insulative substrate is preferably a polymer film which can be oriented or unoriented although other insulative materials can include paper, paper laminates and the like. FIG. 6 illustrates this structure 60 containing patterned or noncontinuous metallic elements 61. The thickness of the metallic elements 61 has been greatly exaggerated with respect to the upper polymeric substrate 62, the lower polymeric substrate 63, and the width of the nonmetallic gaps 65.

In another embodiment of the invention, a diffuser film is provided which includes a planar polymeric substrate, as described above, having opposed surfaces. The polymeric substrate is itself sandwiched between two microwave-interactive layers, which layers are deposited on the opposed surfaces. Each microwave-interactive layer preferably includes discontinuous rectangular metallic elements that are separated from each other by a continuous nonmetallic gap or slot. In one configuration, metallic elements on the opposed surfaces are substantially aligned so that the respective nonmetallic gaps are superimposed one above the other. In this configuration, microwave energy impinging upon a nonmetallic gap will pass substantially unimpeded through the structure. It is particularly preferred, however, that the respective microwave-interactive patterns be in phased array. The term "phased array" refers to displacement of one microwave-interactive layer relative to the other microwave-interactive layer so that some or all of the metallic elements and nonmetallic gaps are not substantially aligned. Thus, some part of one microwave-interactive layer is occluded from some part of the other layer and microwaves passing substantially normal to the surface of one of the metallic layers would encounter a reflective metallized surface at the opposite side of the structure. This can best be illustrated by reference to the cross-section of FIG. 7. An insulative substrate 72 is sandwiched between two microwave-interactive layers 74, 76. Each layer comprises a plurality of reflective microwave-interactive elements 78 separated from each other by a nonreflective gap or slot 80. The layers are displaced with respect to each other. The microwave energy impinging upon one of the layers will be completely or only partially reflected from the structure, depending upon the relative displacement of the two microwave interactive layers.

While not wishing to be bound by any theory, it is believed that one effect of the arrangement of the various reflecting elements deposited on the substrate is to approximate a microwave-transparent surface, depending upon the particular arrangement of reflective, metallic elements and nonreflective gaps between the elements. It is well known that a wire mesh can replace a continuous metal surface for shielding or reflecting electromagnetic radiation. A specific rectangular wire mesh will shield or reflect virtually all of the energy below a certain frequency. This frequency is a function of the mesh dimensions (i.e. the spacing between adjacent wires). The see-through microwave oven door which passes high frequency visible electromagnetic energy but blocks all the lower frequency microwave oven generated energy is one design which exploits this phenomenon. It is possible to design a complementary structure to a wire mesh so that if the wire mesh has a nonreflective area (i.e. the space between the mesh wires), its complement has a reflective area (i.e. a metallic square) and vice versa.

It is believed that a planar structure of metallic elements and nonmetallic areas between the elements which approximates the complement of a wire mesh should pass all the microwave energy which the wire mesh would block. In the specific case in which the wire mesh reflects all of the energy of a single frequency, the wire mesh's complement (the metallic elements and nonmetallic intervening areas) should transmit all of the impinging energy. Therefore, as a two-dimensional mesh approaches its maximum shielding capacity, it is reasonable to infer that its complement, a two-dimensional array of reflective metallic elements separated by nonreflective gaps, would transmit most of the impinging energy.

Applying these principals to metallic materials with a surface resistance less than about 2 ohms per square, these materials can be incorporated in a packaging structure such that the layer would perform as if it was approximately transparent to impinging microwave energy. Thus, these metallic materials whose surface resistance is such that they would normally break down in a microwave oven, would maintain their integrity.

Furthermore, by selecting the particular material of the reflecting coating regions, as well as the physical dimensions of the region such as coating pattern, thickness, width, pitch, and phased array offset it is possible to control both the degree to which the reflective coating regions will modify and reorganize microwave energy and the amount and distribution of energy that is transmitted through the polymeric substrate in the spaces between the regions of reflecting material. For a given material and layer thickness, decreasing the width of a nonmetallic spaces increases the current within the metallic elements and this, in turn, increases reflection of microwave energy. It is also believed that the pattern of reflecting elements described herein will spread out the microwave radiation by microwave energy coupling between adjacent elements of the reflective pattern(s). The diffuser effect may also result from microwave energy tending to diffract when passing across the diffuser film in much the same manner that light diffracts when the light wavefront is partially blocked off by an opaque object containing an aperture.

Figure 7:
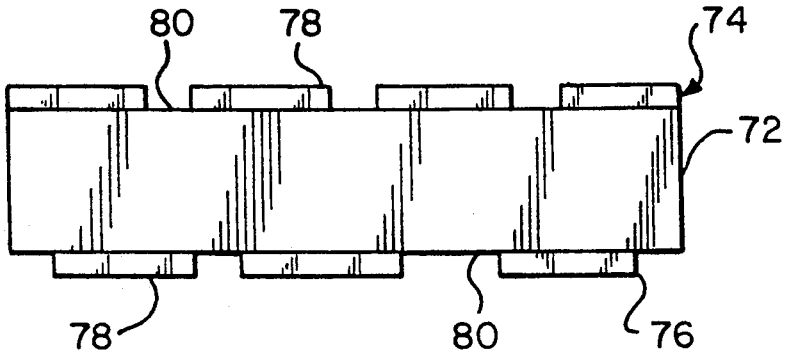
FIG. 7 is a cross-sectional view of another embodiment of the invention.

The theoretical principles outlined above ca be used to design a great number of effective patterns of thin, metallic elements with nonmetallic areas between them. For example, consider two identical rectangular wire meshes, one laid directly over the other; then one of which is displaced horizontally from the first. The resulting system of superimposed wire meshes will reflect electromagnetic energy at least as well as one mesh. This principle can be applied in its complement domain as reflective metallic elements and nonreflective gaps. Thus, a structure consisting of a phased array of rectangular elements as in FIG. 7 is the complementary structure of the above-described two wire mesh system.

Figure 8:
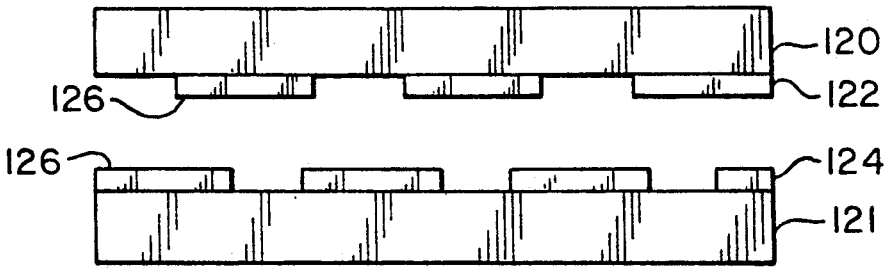
FIG. 8 is a cross-sectional view of another embodiment of FIG. 7.

The structure of FIG. 8 is an alternate embodiment of the phased array structure described previously. Two planar polymeric substrates 120, 121 are in facing relationship. Discontinuous microwave-interactive layers 122, 124 comprising a plurality of microwave-interactive elements 126 are disposed on opposed surfaces of the polymeric substrates so that the elements are in facing relationship. Elements 126 are in phased array, as described previously. Microwave interactive layers 122 and 124 are separated from each other and are not in contact.

Figure 9:
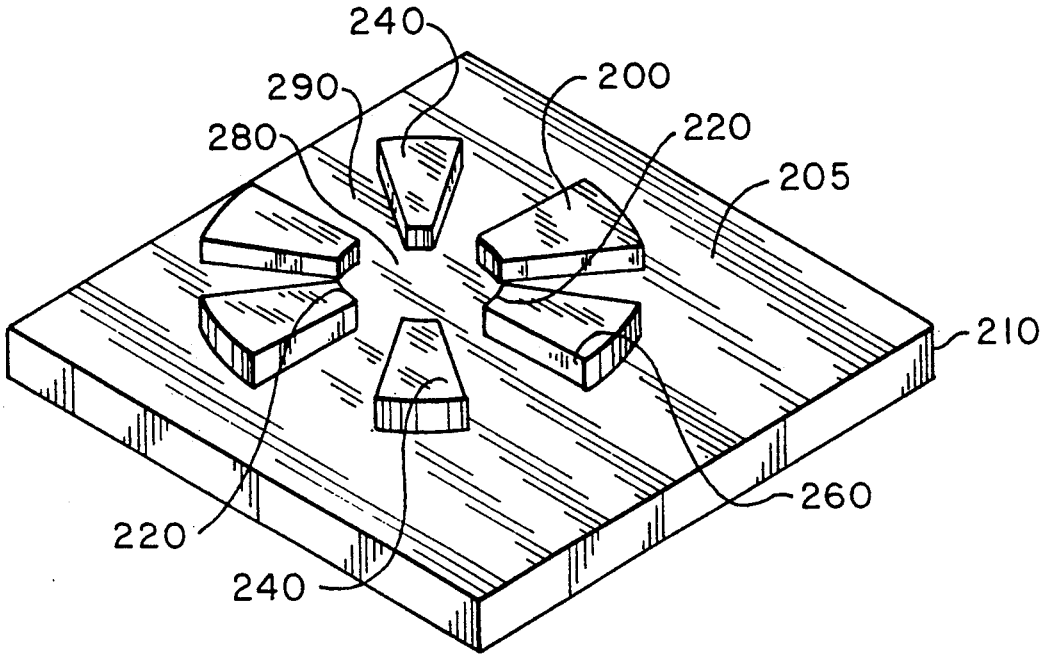
FIG. 9 is a schematic perspective representation of reflecting elements in a pinwheel pattern of the invention.

FIG. 9 illustrates another embodiment of the invention which is designed to spatially distribute microwave energy by focusing the energy at one or more particular points. The so-called "pinwheel" pattern illustrated in FIG. 9 comprises a plurality of elongated metallized elements 200 that are deposited upon a first surface 205 of a microwave transparent polymeric substrate 210. These elongated elements are roughly trapezoidal in shape. Each element has an inner lateral side 220 that is substantially shorter in length than a corresponding outer lateral side 240. These respective inner and outer lateral sides are connected by longitudinal sides 260 of approximately equal length. The metallized elements are arranged adjacent to one another so that the respective inner lateral sides define a central, nonmetallized area 280 roughly circular in shape. The adjacent longitudinal sides 260 are separated from each other by nonmetallized gaps 290 and, as illustrated, the resulting configuration resembles a pinwheel pattern with spokes (i.e. the elongated elements 200) radiating outwardly from a central hub (i.e. the element-free central area 280).

In preferred embodiments, the central, nonmetallized area 280 defined by the inner lateral sides 220 of the metallized elements 200 is less than about one inch in diameter, although it can be larger. Generally, the diameter of the central area is substantially the same as the length of the metallized elements as defined by their longitudinal sides 260. The particular pattern illustrated in FIG. 9 and equivalents thereof tend to focus microwave energy at the central, metal-free area as well as redistribute energy. A food item or a portion of a food item is conveniently placed under the central area 280.

Specifically, individual elements of this particular pattern can focus microwave energy to eliminate cold spots within a microwave field. In one embodiment, the inner lateral sides 220 of the metallized elements 200 are about 3 mm wide and the outer lateral sides 280 are about 6 mm wide, the sides being connected by longitudinal length of about 60 mm. In a pinwheel pattern of this size, the central area can be as large as 75 mm. The number of radiating metallized elements can also preferably vary from about 5 to as many as 36, depending upon the size of the central area. A constraint upon the number and width of metallized elements in the pinwheel pattern of FIG. 9 is the difficulty in maintaining nonmetallized gaps 290 adjacent the inner lateral sides 220 of the pattern as the number of radiating elements increases.

Figure 10:
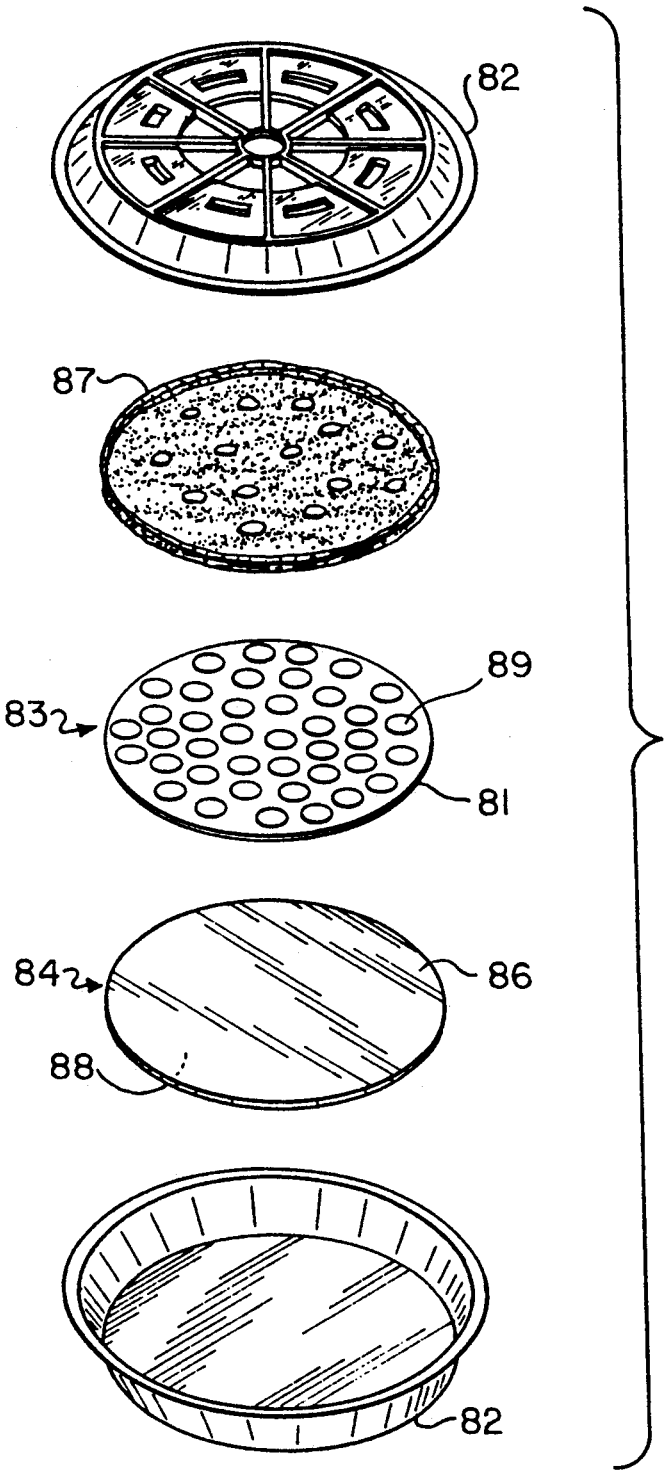
FIG. 10 is a schematic, perspective representation of a food packaging system of the invention.

The diffuser of this invention can also be incorporated into a food packaging system for use in microwave ovens and for microwave heating of food. As illustrated in FIG. 10, a diffuser film 83 of the invention can be used in any standard microwave container or receptacle 82. The diffuser film preferably includes an insulative substrate 81 onto which is deposited any one of the patterned microwave-interactive elements 89, as described previously herein.

Typical receptacles may include a susceptor means 84 that provides a heating element which directly contacts and heats foods 87 in response to microwave radiation. This susceptor 84 is typically a thin film of metal 86 deposited upon a sheet of polyester, or other flexible material 86. The metalized polyester may then be bonded to a sheet of paper or a paper board if rigidity is desired. When the susceptor is exposed to microwave radiation, it can become relatively hot.

The diffuser film of the invention can be incorporated into the packaging system because the diffuser film does not itself become substantially heated and, therefore, does not heat the food directly. The film can be positioned in a variety of configurations within the packaging system and it does not have to be in direct contact with the food or the susceptor. Thus, the diffuser film can be positioned in between the microwave source and the food, or alternatively, as illustrated in FIG. 10, it can be positioned below or to the side of the food. Various configurations for microwave food packaging systems are well known in the art. See, for example, U.S. Pat. No. 4,940,867 (Pelag); U.S. Pat. No. 4,190,757 (Turpin) and U.S. Pat. No. 4,641,005 (Seiferth), incorporated by reference herein.

Figure 11:
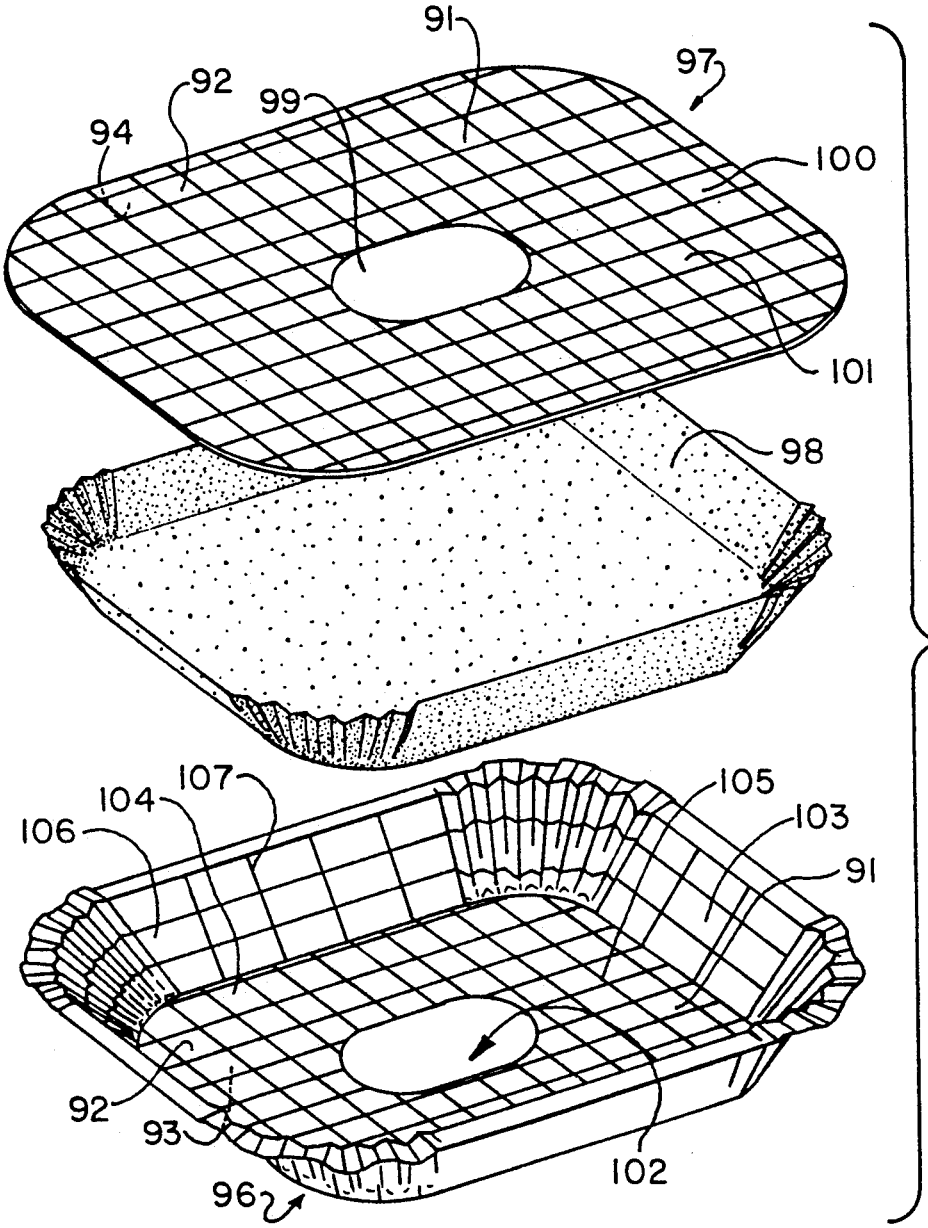
FIG. 11 is a schematic, perspective representation of another food packaging system of the invention.

Many other configurations of microwave diffuser films for a food packaging system can be readily developed by those skilled in the art without significantly departing from the scope of this invention. For example, heating a rectangularly shaped, frozen food product such as a casserole frequently results in the casserole's extremities being overheated and the center underheated. To improve the heating uniformity of this type of food product, a structure such as FIG. 11 can be employed. For example, to reheat a precooked, frozen single serving 98 which takes the shape of the tray, a tray 96 incorporating the "sandwich" configuration of FIG. 6 and with lidding material 97 made from the same structure would be used. A specific tray 96 for this example can be formed from a laminate of 22 gauge sulfate bleached paperboard as the lower substrate 93 and 48 gauge polyethylene (PET) as the upper substrate 92. A thin layer of patterned aluminum 91 with a resistance in the range of 0.1 to 2.5 ohms per square is sandwiched between the PET film and the paperboard sheet. A lid 97 can include an upper substrate 92 of 48 gauge metallized PET laminated to another 48 gauge PET lower substrate 94. Between the PET is sandwiched an aluminum layer 91 in the range of 0.1 to 2.5 ohms per square.

The lid 97 has two distinct areas; the approximately rectangular area 99 without a metallic layer in the center of the lid which measures about two inches by about one inch and the periphery of the lid, in the shape of a rectangular annulus. On the periphery of the lid are square metallic elements 100 about 5 mm on a side and having about 0.5 mm gaps 101 between them. This design allows more of the microwave oven generated energy which impinges the lid 97 to enter through the center than the periphery.

Likewise, the tray 96 has three distinct areas, each with a different microwave transmission characteristic.

The center base 102 of the tray allows maximum entry of the microwave energy which impinges its surface, while the remaining patterned base area permits less of the energy to pass through the structure. The least amount of microwave energy enters through the side walls 103. The square metallic conductive elements 104 in the base of the tray are about 6 mm on the side, the nonmetallic gaps 105 are about 0.4 mm wide, while the square metallic elements 106 on the side walls 103 of the tray are about 1 cm on a side with a 0.25 mm gap between them 107. The rectangular annulus 102 without metal in the base of the tray measures two inches by about one inch.

Referring again to FIG. 11, the lid 97 and/or tray can also include one or more "pinwheel" patterns of FIG. 9, whose central area(s) are located approximately at the center of the lid or tray.

This microwave packaging system remarkably improves the heating of precooked single servings with the center of the serving being microwave-heated at approximately the same rate as the other areas.

EXAMPLES

Example 1

Figure 12A:
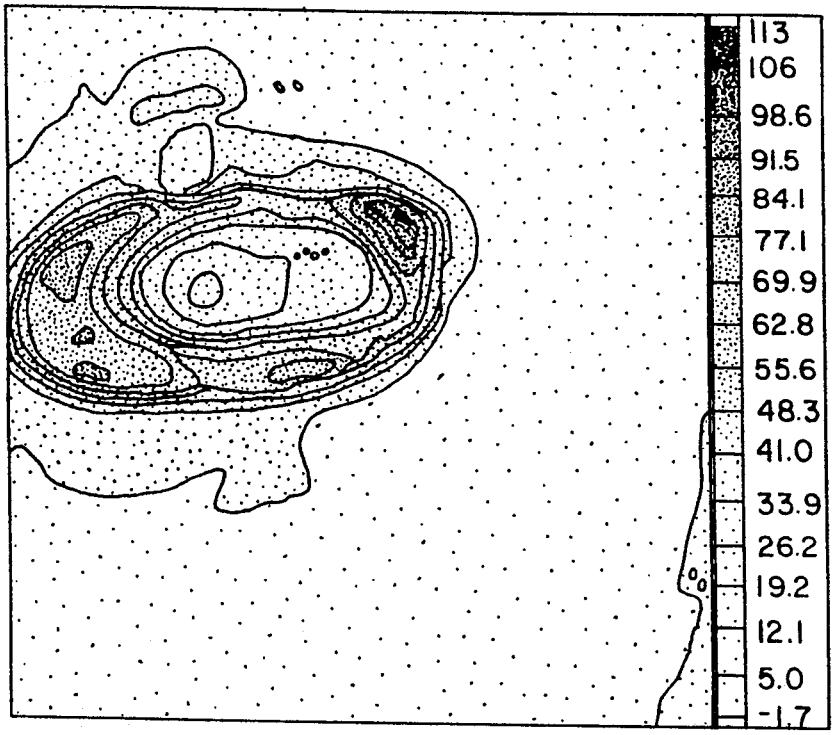
FIG. 12A is a digitized infrared image of the heat distribution in a food product cooked using a commercial susceptor.
Figure 12B:
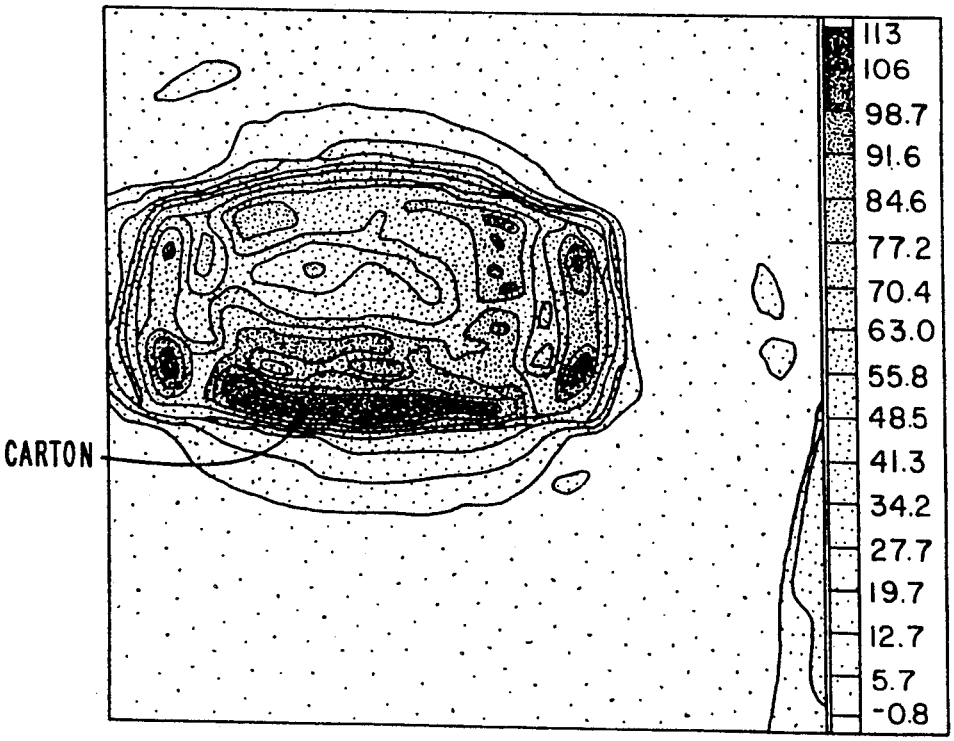
FIG. 12B is a digitized infrared image of the heat distribution in a food product cooked using the diffuser film of the invention.

In this example, an infrared camera was used to determine the heat distribution of a food product using standard, commercially available susceptors as compared to the selectively permeable susceptor of the invention. An Agema infrared camera (Stockholm, Sweden) was used in conjunction with an IBM-compatible microprocessor to provide digitized images of heat-distribution in a food product after irradiation of the food product under standard conditions in a microwave oven. The digitized images of the infrared radiation (heat) emanating from a food product was interfaced with a software package to determine the spatial distribution of temperature, and to perform analyses of minimum, maximum, average temperature and standard deviation thereof. FIG. 12A is a digitized image of heat distribution and relative temperature values of a food product (pepperoni-stuffed french roll) after cooking for 2.5 minutes in a standard microwave oven. After cooking, the digitized infrared image shows that the material on the top of the food product in the center was not adequately cooked. An identical food product was covered with the metallized microwave diffuser film of this invention. The food product was cooked for an 2.5 minutes under identical microwave conditions. The digitized infrared image (FIG. 12B) shows that the central portion of the food product was completely cooked and the average temperature of the food was 81° C., as compared to an average temperature of 63° C. for the food product lacking the diffuser film. The hottest portion of the food was the receptacle, illustrated at the bottom of FIG. 12B as "carton". This particular example illustrates one property of the diffuser film of the invention, namely its ability to focus infrared radiation at a particular point or points. The approximate additional cost of materials to fabricate the diffuser film in this particular example is less than 0.5¢ per package.

Equivalents

Although the specific features of the invention are shown in some drawings and not in others, this is for convenience only, as each feature may be combined with any or all of the other features in accordance with the invention.

It should be understood, however, that the foregoing description of the invention is intended merely to be illustrative thereof, that the illustrative embodiments are presented by way of example only, that other modifications, embodiments, and equivalents may be apparent to those skilled in the art without departing from its spirit.

Having thus described the invention, what we desire to claim and secure by Letters Patent is:

1. A microwave diffuser film for use during microwave heating of objects, comprising:

(a) a first substrate that is substantially transparent to microwave energy, the substrate having a first surface for receiving a microwave energy field and at least one second surface across which microwave energy is transferred; and (b) microwave-interactive elements deposited on the first surface for interacting with microwave energy received thereon to produce a modified microwave energy field and to transfer said microwave energy field across said at least one second surface, said microwave-interactive elements comprising a plurality of discrete metallic elements having a sheet resistance in the range of 2.0 to 0.05 ohms per square arranged in a pattern so that the transferred microwave energy field is substantially uniform, the metallic elements separated by nonmetallic areas, said metallic elements substantially incapable of converting microwave energy to heat.

2. The microwave diffuser film of claim 1, wherein the metallic elements are vapor-deposited.

3. The microwave diffuser film of claim 2, wherein the metallic elements include metallic material selected from the group consisting of a single metal, a metal alloy, a metal oxide, a mixture of metal oxides, a dispersion of metals, and combinations of the foregoing metallic material.

4. The microwave diffuser film of claim 3, wherein the metallic material is selected from the group consisting of aluminum, iron, tin, tungsten, nickel, stainless steel, titanium, magnesium, copper, and chromium.

5. The microwave diffuser film of claim 1, wherein the first substrate is an electrical insulator comprising a polymeric material selected from the group consisting of polyolefins, polyesters, polyamides, polyimides, polysulfones, polyethers, ketones, cellophanes and combinations of the foregoing polymeric materials.

6. The microwave diffuser film of claim 1, further comprising a second substrate in contact with the microwave-interactive elements, the second substrate substantially transparent to microwave energy.

7. The microwave diffuser film of claim 6, wherein the second substrate is an electrical insulator comprising a polymeric material selected from the group consisting of polyolefins, polyesters, polyamides, polyimides, polysulfones, polyethers, ketones, cellophanes and combinations of the foregoing polymeric materials.

8. The microwave diffuser film of claim 1, wherein said metallic elements have an area ranging from about 1 $mm^2$ to about 625 $mm^2$.

9. A microwave diffuser film for use during microwave heating of objects, comprising:

(a) a first substrate that is substantially transparent to microwave energy, the substrate having a first surface for receiving a microwave energy field and at least one second surface across which microwave energy is transferred; and (b) microwave-interactive elements deposited on the first surface for interacting with microwave energy received thereon to produce a modified microwave energy field and to transfer said microwave energy field across said at least one second surface, said microwave-interactive elements comprising a plurality of discrete metallic elements having a sheet resistance in the range of 2.0 to 0.05 ohms per square arranged in a pattern so that the transferred microwave energy field is substantially uniform, the metallic elements separated by nonmetallic areas, said metallic elements substantially incapable of converting microwave energy to heat, wherein the metallic elements are arranged in a pinwheel pattern.

10. A microwave diffuser film for use in food packaging, comprising:

(a) a flexible substrate having opposed first and second surfaces, said substrate being substantially transparent to microwave energy from a microwave energy source;

(b) a plurality of first microwave-interactive elements deposited on the first surface of the substrate for spatially distributing microwave energy produced by the microwave energy source and received upon said first microwave-interactive elements, the first microwave-interactive elements arranged in a discontinuous pattern, said elements separated by first continuous, nonmicrowave-interactive areas;

(c) a plurality of second microwave-interactive elements deposited on the second surface of the substrate for spatially distributing microwave energy received upon said elements, the second microwave-interactive elements arranged in a discontinuous pattern, said second microwave-interactive elements separated by second continuous, nonmicrowave-interactive areas, the first and second microwave-interactive elements of both surfaces substantially incapable of converting microwave energy into heat.

11. The microwave diffuser film of claim 10, wherein the first and second microwave-interactive elements include metal-containing material selected from the group consisting of a single metal, a metal alloy, a metal oxide, a mixture of metal oxides, a dispersion of metals, and combinations of the foregoing metal-containing material.

12. The microwave diffuser film of claim 11, wherein the microwave-interactive elements are vapor-deposited.

13. The microwave diffuser of claim 12, wherein the first microwave-interactive elements comprises a plurality of quadrilateral microwave reflective elements in a pattern, said pattern covering at least about 85% to about 95% of the surface area of the first surface of the substrate.

14. The microwave diffuser of claim 11, wherein the first and second microwave-interactive elements have a resistivity between about 0.05 and about 2.0 ohms per square.

15. The microwave diffuser of claim 10, wherein the plurality of second microwave-interactive elements deposited on the second surface of the substrate are in phased array relative to the first microwave-interactive elements deposited on the first surface of the substrate.

16. The microwave diffuser of claim 10, wherein the substrate is an electrical insulator comprising a polymer material selected from the group consisting of polyolefins, polyesters, polyamides, polyimides, polysulfones, polyethers, ketones, cellophanes, and combinations of the foregoing polymeric material.

17. The microwave diffuser film of claim 10, wherein said first and second microwave-interactive elements have an area ranging from about 1 $mm^2$ to about 625 $mm^2$ and said first and second nonmicrowave-interactive areas range from about 0.2 mm to about 2.0 mm.

18. A food package for microwave cooking of food contained therein, having a susceptor for converting microwave energy into heat;

a diffuser for achieving uniformity of heating;

wherein said susceptor and said diffuser are copackaged so that microwave energy passes through both and that the heat produced by the susceptor is capable of reaching the food;

wherein the diffuser includes a substrate having a first surface for receiving microwave energy from a microwave source and a second surface across which microwave energy is transferred, the substrate having deposited on the first surface a plurality of microwave-interactive elements for spatially distributing microwave energy received thereon, said microwave-interactive elements substantially incapable of converting microwave energy into heat, said microwave-interactive elements having a sheet resistance in the range of 2.0 to 0.05 ohms per square arranged in a discontinuous pattern so that the transferred microwave energy field is substantially uniform, the microwave-interactive elements separated from each other by a continuous gap lacking said microwave-interactive elements.

19. The food package of claim 18, wherein the substrate of the diffuser is an electrical insulator comprising a polymeric material selected from the group consisting of polyolefins, polyesters, polyamides, polyimides, polysulfones, polyethers, ketones, cellophanes, and combinations of the foregoing polymeric material.

20. The food package of claim 18, wherein the microwave-interactive elements include metal-containing material selected from the group consisting of a single metal, a metal alloy, a metal oxide, a mixture of metal oxides, a dispersion of metals, and combinations of the foregoing metal-containing material.

21. The food package of claim 19, wherein the discontinuous pattern of microwave-interactive elements comprises a plurality of quadrilateral microwave-reflective elements covering at least about 85% to about 90% of the surface area of the first surface of the substrate.

22. The food package of claim 21, wherein the reflecting elements are vapor-deposited.

23. The food package of claim 18, wherein the continuous gap lacking said microwave-interactive elements includes at least one substantially rectangular-shaped gap.

24. The food package of claim 18, further comprising a second plurality of microwave-interactive elements for spatially distributing microwave energy, said second plurality of microwave-interactive elements deposited on the second surface of the substrate in a discontinuous pattern, the second plurality of microwave-interactive elements separated from each other by a continuous gap lacking said microwave-interactive elements, said second plurality of microwave-interactive elements substantially incapable of converting microwave energy into heat.

25. The food package of claim 24, wherein the plurality of elements deposited on said first and second substrate surfaces are in phased array relative to each other.

26. A microwave diffuser film for use in food packaging, comprising:

(a) a flexible substrate having opposed first and second surfaces, said substrate being substantially transparent to microwave energy from a microwave energy source;

(b) a plurality of first microwave-interactive elements deposited on the first surface of the substrate for spatially distributing microwave energy produced by the microwave energy source and received upon said first microwave-interactive elements, the first microwave-interactive elements arranged in a discontinuous pattern, said elements separated by first continuous, nonmicrowave-interactive areas;

(c) a plurality of second microwave-interactive elements deposited on the second surface of the substrate for spatially distributing microwave energy received upon said elements, the second microwave-interactive elements arranged in a discontinuous pattern, said second microwave-interactive elements separated by second continuous, nonmicrowave-interactive areas, the first and second microwave-interactive elements of both surfaces substantially incapable of converting microwave energy into heat, wherein the first and second plurality of microwave-interactive elements are in a pinwheel configuration on a surface of the substrate, the surface selected from the group consisting of the first surface, the second surface and both first and second surfaces.

27. A food package for microwave cooking of food contained therein, having a susceptor for converting microwave energy into heat;

a diffuser for achieving uniformity of heating;

wherein said susceptor and said diffuser are copackaged so that microwave energy passes through both and that the heat produced by the susceptor is capable of reaching the food;

the diffuser including a substrate having a first surface for receiving microwave energy from a microwave source and a second surface across which microwave energy is transferred, the substrate having deposited on the first surface a plurality of microwave-interactive elements for spatially distributing microwave energy received thereon, said microwave-interactive elements substantially incapable of converting microwave energy into heat, said microwave-interactive elements having a sheet resistance in the range of 2.0 to 0.05 ohms per square arranged in a discontinuous pattern so that the transferred microwave energy field is substantially uniform, the elements separated from each other by a continuous gap lacking said microwave-interactive elements, wherein the plurality of microwave-interactive elements are arranged in a pinwheel pattern.

* * * * *